United States Patent [19]

Heitmann et al.

[11] Patent Number: 4,632,130

[45] Date of Patent: Dec. 30, 1986

[54] METHOD AND APPARATUS FOR MAKING A ROD-LIKE FILLER OF SMOKABLE MATERIAL

[75] Inventors: Uwe Heitmann, Hamburg; Heinz-Christen Lorenzen, Wentorf; Wolfgang Steiniger, Börnsen, all of Fed. Rep. of Germany

[73] Assignee: Hauni-Werke Korber & Co. KG., Hamburg, Fed. Rep. of Germany

[21] Appl. No.: 660,430

[22] Filed: Oct. 11, 1984

[30] Foreign Application Priority Data

Oct. 12, 1983 [DE] Fed. Rep. of Germany ..... 3337034

[51] Int. Cl.[4] ..... A24C 5/18

[52] U.S. Cl. ..... 131/84.3; 131/84.2; 131/84.3; 131/84.4; 131/360; 131/364

[58] Field of Search ..... 131/84 R, 84 A, 84 B, 131/84 C, 364, 360, 84.1, 84.2, 84.3, 84.4

[56] References Cited

U.S. PATENT DOCUMENTS 4,249,544 2/1981 Reuland et al. ..... 131/84 C
4,391,285 7/1983 Burnett et al. ..... 131/364

FOREIGN PATENT DOCUMENTS 1164907 5/1964 Fed. Rep. of Germany .... 131/84 R
1338546 8/1963 France ..... 131/84.1
1086443 10/1967 United Kingdom ..... 131/364

*Primary Examiner*—V. Millin
*Attorney, Agent, or Firm*—Peter K. Kontler

[57] ABSTRACT

A tobacco filler is formed in a machine which turns out two trough-shaped tobacco streams whose concave sides face each other. The two streams are thereupon caused to merge and to form a single stream whose central portion is less dense than the outer layer. The single stream is then compacted in the wrapping mechanism of the machine so that its cross section matches that of a cigarette, and the resulting filler is draped into cigarette paper prior to subdivision into discrete cigarettes of desired length. The density of the central portion of the filler in each cigarette is less than the density of the layer which is immediately adjacent to the wrapper. This improves the burning characteristics of the cigarettes and allows for a reduction of the quantity of tobacco which is needed to make a cigarette exhibiting a desired firmness. The single stream can be formed around a mandrel which reduces the likelihood of penetration of tobacco particles into the central portion of the single stream ahead of the wrapping station and which can also serve to admit moisture, volatile flavoring agents and/or heated or unheated air into the adjacent particles of the trough-shaped streams or into the adjacent particles of the single stream.

27 Claims, 12 Drawing Figures

133a
104a
116a
134a
283a
283
106a
133b
106b
118b
118a
281
134b
116b
104b
132b
132a
112
113
165
166
101
102
103
106a
106b
387
387a
386
388
381
A
B
C
Z1
Z2
Z3

METHOD AND APPARATUS FOR MAKING A ROD-LIKE FILLER OF SMOKABLE MATERIAL

CROSS-REFERENCE TO RELATED CASES

Certain details of the apparatus which are disclosed in the present application are similar to those of the apparatus which are described and shown in commonly owned copending patent application Ser. Nos. 557,641 (filed Dec. 2, 1983 by Heitmann), 557,733 (filed Dec. 2, 1983 by Wahle et al.), 557,735 (filed Dec. 2, 1983 by Wahle et al.) and 572,564 (filed Jan. 18, 1984 by Wahle et al.). Reference may also be had to the commonly owned copending patent application Ser. No. 660,431 filed on even date.

BACKGROUND OF THE INVENTION

The present invention relates to improvements in methods and apparatus for making rod-like streams of smokable materials, especially for making streams which consist of or contain natural tobacco, reconstituted tobacco and/or substitute tobacco and can be converted into the fillers of cigarettes or other rod-shaped smokers' products.

German Pat. No. 11 64 907 discloses a cigarette whose filler is formed with a centrally located longitudinally extending air channel. The cigarette is formed by inserting into the filler a stationary mandrel which serves to continuously admit into the surrounding portion of the filler a hardening agent in order to ensure that the axially extending channel remains intact upon extraction of the mandrel.

British Pat. No. 1,086,443 discloses a cigarette with a centrally extending cylindrical passage or with a core whose density is less than the density of the surrounding outer layer of the filler. This is supposed to slow down the rate of combustion and to reduce the temperature of tobacco smoke.

OBJECTS AND SUMMARY OF THE INVENTION

An object of the invention is to provide a cigarette or an analogous rod-shaped smokers' product which has a central portion of lesser density and an outer layer of greater density and which can be mass-produced at a fraction of the cost of heretofore known smokers' products exhibiting such characteristics.

Another object of the invention is to provide a novel and improved method of making rod-shaped smokers' products of the above outlined character.

A further object of the invention is to provide a novel and improved apparatus for the practice of the method.

An additional object of the invention is to provide the apparatus with novel and improved means for assembling several discrete streams of smokable particles into the filler of a rod-shaped article wherein the density of the central portion of the filler is zero or a fraction of the density of the surrounding layer.

Still another object of the invention is to provide an apparatus which can be used in existing cigarette rod making or like machines for the mass-production of rod-shaped smokers' products with fillers having cores whose density is less pronounced than that of the surrounding layers.

A further object of the invention is to provide a simple method of making rod-shaped smokers' products of the above outlined character.

Another object of the invention is to provide a method and an apparatus which ensure that the quantity of flavoring agents which must be introduced into the fillers of cigarettes or analogous smokers' products is a minute fraction of the quantities of flavoring agents which must be admitted in presently known apparatus in order to ensure adequate treatment of smokable particles prior to their conversion into the fillers of discrete cigarettes or the like.

A further object of the invention is to provide an apparatus which ensures highly accurate selective admission of moisture into the fillers of cigarettes or the like.

Another object of the invention is to provide a rod-shaped smokers' product wherein the density of the central portion of the filler remains less pronounced than in the outer layer in spite of the absence of hardening agents in the filler.

Still another object of the invention is to provide a novel and improved method of predictably densifying the filler of a cigarette or the like wherein the central portion is less dense than the surrounding layer.

An additional object of the invention is to provide an apparatus for the making of the above outlined smokers' products with novel and improved means for admitting moisture, flavoring agents and/or other flowable substances into the smokable material.

One feature of the invention resides in the provision of a method of forming a continuous rod-like filler from particles of smokable material, such as natural tobacco, reconstituted tobacco and/or substitute tobacco. The method comprises the steps of accumulating the particles into discrete continuous first and second trough-shaped or gutter-shaped streams, merging the two streams into a single continuous third stream having a tubular outer layer and a central portion or core whose density is less than that of the outer layer (for example, the density of the core can be zero or, at the very least, the density of the outer layer can be several times the density of the core), and converting the third stream into a continuous rod-like filler having a central portion or core of lesser density and an annular or tubular outer layer of greater density. The converting step preferably includes subjecting the third stream to the action of substantially radially oriented densifying forces which can act radially inwardly against the external surface of the outer layer and/or radially outwardly against the interior of the outer layer.

The accumulating step can include imparting to each of the first and second streams a substantially U-shaped or V-shaped cross-sectional outline with a concave inner side, and the merging step can comprise moving the first and second streams along convergent paths wherein their concave sides face each other. It is presently preferred to resort to an accumulating step which includes showering smckable particles into two discrete elongated paths and establishing a pressure differential at the opposite sides of each path so that the particles are pneumatically held in their respective paths. The pressure differential establishing step can comprise placing an air-permeable conveyor into each of the two paths and evacuating air from one side of the conveyor; the showering step then includes delivering smokable particles to the other side of each conveyor.

The method preferably further comprises the step of advancing the first and second streams along at least substantially horizontal paths, at least prior to the merging step. The path of the third stream is or can be horizontal. In such method, the accumulating step can comprise placing air-permeable conveyors into the bottom regions of troughs having a substantially U-shaped cross-sectional outline, and showering the particles against the conveyors so that each of the first and second streams has a substantially U-shaped or V-shaped cross-sectional outline. The showering step can include propelling the particles at an elevated speed and at an oblique angle to the direction of movement of the conveyors to form a first portion of each of the first and second streams (preferably the web or bottom part of the respective U-shaped or V-shaped stream). Such showering step can further comprise propelling the particles at an elevated speed and in at least substantial parallelism with the direction of movement of the conveyors to thus form the remainder of each of the first and second streams (preferably a first flange or leg and then a second flange or leg of each U-shaped or V-shaped stream).

The tubular outer layer of the third stream can have a substantially square or rectangular cross-sectional outline, and the outer layer of the filler can have a substantially circular or oval cross-sectional outline.

Another feature of the invention resides in the provision of an apparatus for forming a rod-like filler from smokable particles, such as shredded or otherwise comminuted natural tobacco, substitute tobacco and/or reconstituted tobacco. The apparatus comprises first and second conveyor means each of which has a concave side, means for supplying to the concave side of each conveyor means smokable particles to thus form thereon continuous first and second streams having concave sides, and means for merging the first and second streams on the two conveyor means into a third stream wherein the concave sides of the first and second streams face each other. The central portion or core of the third stream is less dense than the tubular or annular outer layer of the third stream. The third stream can be converted into a rod-like filler which is then draped in a web of cigarette paper or the like and is subdivided to yeild a succession of rod-shaped smokable articles, particularly cigarettes, cigars or cigarillos.

Each of the two conveyor means can comprise a belt conveyor, and the supplying means preferably includes means for showering smokable particles onto the two belt conveyors. It is preferred to employ belt conveyors which are permeable to air and each of the conveyor means then preferably further comprises a suction chamber adjacent to the respective belt conveyor opposite the concave side of the corresponding conveyor means so that the smokable particles which are showered against or onto the concave sides of the two conveyor means are attracted to the respective belt conveyors by suction. The conveyor means preferably define at least substantially horizontal paths for the first and second streams and preferably also for a portion of or the entire third stream. Each conveyor means can be said to define an elongated gutter or trough having a bottom wall which is constituted by the respective air-permeable belt conveyor. Each conveyor means preferably further comprises two stationary or mobile sidewalls which flank the respective bottom wall. The supplying means then preferably comprises for each conveyor means a first unit which serves to deliver smokable particles to the bottom wall (belt conveyor) of the respective conveyor means and at least one additional unit serving to deliver smokable particles to the sidewalls of the respective conveyor means.

The apparatus can further comprise an elongated stationary mandrel or an analogous insert which is disposed between the conveyor means, at least in the region of the merging means, to prevent penetration of smokable particles into the central portion of the third stream. Such apparatus preferably further comprises means for reducing friction between the smokable particles and the mandrel. For example, the friction reducing means can comprise means for admitting air into air-discharging openings which are provided in the mandrel. Alternatively, or in addition to such friction reducing means, the apparatus can comprise means for vibrating the mandrel, preferably at a frequency which is in the ultrasonic range. This also contributes to a reduction of friction between the smokable particles and the mandrel.

The apparatus can further comprise one or more sources of volatile and/or non-volatile flavoring agents and means for admitting such agents into the first, second and/or third stream by way of the mandrel. Alternatively, or in addition to the admission of flavoring agent or agents and/or friction reducing air, the mandrel can serve for admission of heated air which also contributes to a reduction of friction and, at the same time, facilitates movements of particles relative to each other during conversion of the third stream into a rod-like filler with a core of lesser density and an outer layer of greater density. Still further, the mandrel can serve for admission into the first, second and/or third stream of moist air and/or steam, and the apparatus then preferably comprises means for regulating the rate of admission of moist air and/or steam by way of the mandrel in such a way that the moisture comes in contact only with the central portion of the third stream, i.e., that the outer layer of the third stream is not affected by admitted moist air and/or steam.

The means for condensing the third stream in order to convert it into a rod-like filler which is ready to be wrapped into a web of cigarette paper or other suitable wrapping material can be of conventional design, e.g., of the type known from presently used cigarette rod making machines, and the mandrel preferably extends into or close to the condensing means.

An additional feature of the invention resides in the provision of a novel article of manufacture which is a rod-shaped smokers' product (such as a cigarette) and has an elongated composite filler consisting of two condensed trough- or gutter-shaped streams having concave sides facing each other. The filler contains smokable particles and includes a tubular outer layer of greater density and a central portion or core of lesser density. The central portion of the filler can be at least substantially devoid of smokable particles or the density of the outer layer of the filler can be several times the density of the central portion.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 5, 6, 7:
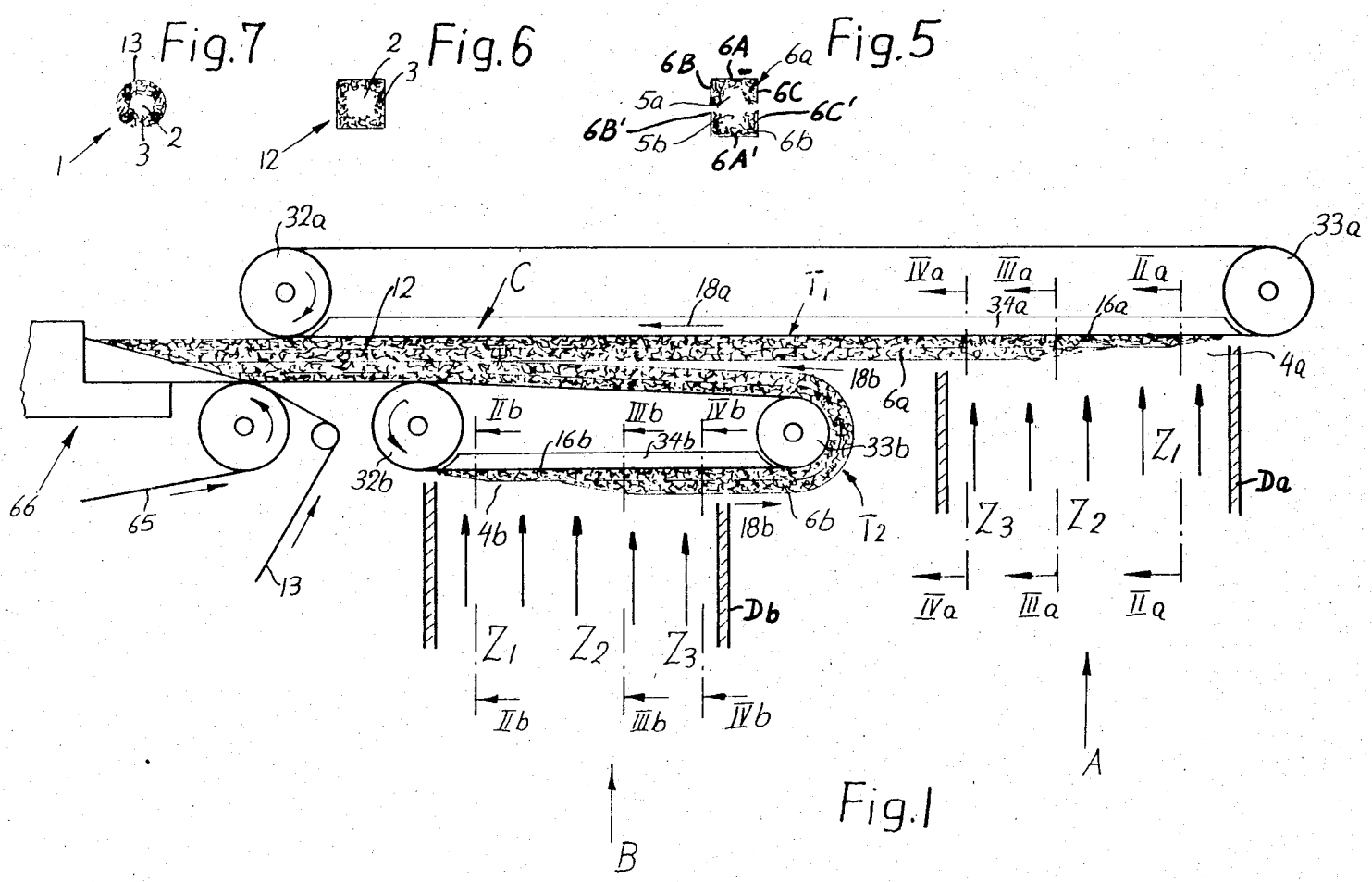
FIG. 1 is a schematic elevational view of the filler forming and rod forming zones of a cigarette rod making machine embodying an apparatus which is constructed and assembled in accordance with the invention.
FIG. 5 is a schematic cross-sectional view of two substantially trough-shaped streams which are about to be assembled into a third stream having a low-density core and a denser outer layer.
FIG. 6 is a similar cross-sectional view of the third stream.
FIG. 7 is a similar cross-sectional view of a wrapped rod whose filler constitutes a condensed stream of the type shown in FIG. 6.

Referring first to FIG. 1, there is shown a portion of a cigarette rod making machine having a filler making apparatus which embodies one form of the invention. The filler forms part of a continuous cigarette rod 1 which is shown in FIG. 7 and comprises a central portion or core 2 as well as an annular outer layer or shell 3 whose density exceeds that of the core 2. The rod 1 further comprises a tubular wrapper 13 consisting of cigarette paper or the like.

The filler forming apparatus of FIG. 1 comprises a first conveying means T1 and a second conveying means T2. The conveying means T1 comprises a first endless foraminous belt conveyor 16*a* which is trained over pulleys 32*a*, 33*a* and has an elongated lower reach which is at least substantially horizontal. The lower reach of the belt conveyor 16*a* constitutes the bottom wall of a substantially U-shaped trough 4*a* which is defined by the conveying means T1 and further includes two stationary sidewalls 19 and 21 (see FIGS. 2, 3 and 4). The means for supplying particles P of smokable material (e.g., shreds of tobacco leaf laminae) comprises an upright duct Da which is disposed below the lower reach of the belt conveyor 16 in a showering zone A and serves to deliver smokable particles P in such a way that the thus supplied particles form a first stream 6*a* (FIG. 5) having a downwardly facing concave side 5*a* and including a central portion or web 6A at the underside of the lower reach of the conveyor 16*a* and two downwardly extending relatively short legs or flanges 6B, 6C which are respectively adjacent to the inner sides of the sidewalls 19 and 21. The lower reach of the conveyor 16*a* transports the first stream 6*a* along a substantially horizontal path toward a region C of merger with a mirror symmetrical second stream 6*b* which is formed adjacent to the lower reach of the endless belt conveyor 16*b* of the second conveying means T2. The conveyor 16*b* is trained over pulleys 32*b*, 33*b* and its lower reach is adjacent to the open upper portion of a second tobacco supplying duct D2 in the showering zone B of FIG. 1. The lower reach of the conveyor 16*b* constitutes the bottom wall of a second substantially U-shaped trough 4*b* which forms part of the conveying means T2 and further comprises two sidewalls corresponding to the sidewalls 19, 21 of the trough 4*a*.

The second stream 6*b* also comprises a central portion or web 6A′ and two flanges or legs 6B′, 6C′ which extend upwardly from the web 6A′. The orientation of the stream 6*b* is changed by 180° (i.e., the stream 6*b* is turned upside down) during travel around the pulley 33*b* so that the concave sides 5*a*, 5*b* of the streams 6*a*, 6*b* thereupon face each other during travel toward the region C of merger of the streams 6*a*, 6*b* into a third stream 12. The latter is shown in FIG. 6 and has a square or substantially square cross-sectional outline with a tubular outer layer 3 and a softer central portion or core 2.

The upper side of the lower reach of the conveyor 16*a* is adjacent to a first suction chamber 34*a* from which air is evacuated by a suction fan or another suitable suction generating device 36 (see FIG. 2) by way of a suction pipe 35. A similar suction chamber 34*b* is adjacent to the upper side of the lower reach of the conveyor 16*b*. The suction chambers 34*a* and 34*b* ensure that the webs 6A and 6A′ adhere to the respective conveyors 16*a*, 16*b* by suction during the formation of the streams 6*a*, 6*b* as well as during subsequent transport of these streams toward the region C of merger to form the third stream 12.

It will be noted that the inverted fully grown stream 6*b* advances with the upper reach of the conveyor 16*b* along a substantially horizontal path. The pulleys 32*a* and 32*b* can be said to constitute or to form part of a means for merging the streams 6*a*, 6*b* on the conveyors 16*a*, 16*b* into the third stream 12. The concave sides 5*a*, 5*b* of the streams 6*a*, 6*b* face each other on their way toward the region C of merger into the stream 12. The central portion or core 2 of the stream 12 can be devoid of any smokable particles or it can contain particles which form a relatively loose mass having a density which is a fraction of the density of the surrounding outer layer 3.

The third stream 12 is thereupon densified in a wrapping mechanism 66 of conventional design which subjects the stream 12 to the action of radially or substantially radially inertly directed forces so that the outer layer 3 assumes a substantially cylindrical shape as shown in FIG. 7. The machine which includes the apparatus of FIG. 1 further comprises a source (e.g., a bobbin) of wrapping material 13 (such as cigarette paper) which is advanced through the wrapping mechanism 66 by an endless belt conveyor 65. The latter also transports the finished cigarette rod 1 past a sealer where the seam of adhesive between the overlapping marginal portions of the wrapper 13 is heated to induce rapid setting of adhesive before the rod 1 is caused to pass through a customary cutoff which subdivides it into rod-shaped articles of unit length or multiple unit length. The manner in which the web 13 is draped around the filler (which is obtained in response to compacting of the third stream 12) so that one of its marginal portions extends tangentially from the filler and advances along a suitable paster, and the manner in which the thus coated marginal portion is folded over the other marginal portion of the web 13 to form the seam is conventional and is not specifically shown in the drawing. Reference may be had to commonly owned U.S. Pat. No. 4,249,544 granted Feb. 10, 1981 to Reuland et al.

It has been found that, quite surprisingly, the central portion or core 2 of the filler of the finished cigarette rod 1 is much less dense than the surrounding annular outer layer 3. Such difference between the densities of the parts 2 and 3 of the filler exists even if the third stream 12 undergoes a very pronounced densifying action during passage through the wrapping mechanism 66. A comparison of FIGS. 6 and 7 will reveal that the cross-sectional area of the filler in the rod 1 is a fraction of the cross-sectional area of the stream 12; nevertheless, the difference between the densities of the parts 2 and 3 of the filler of the rod 1 exists and is or can be substantially the same as that between the parts 2 and 3 of the stream 12.

Figure 2:
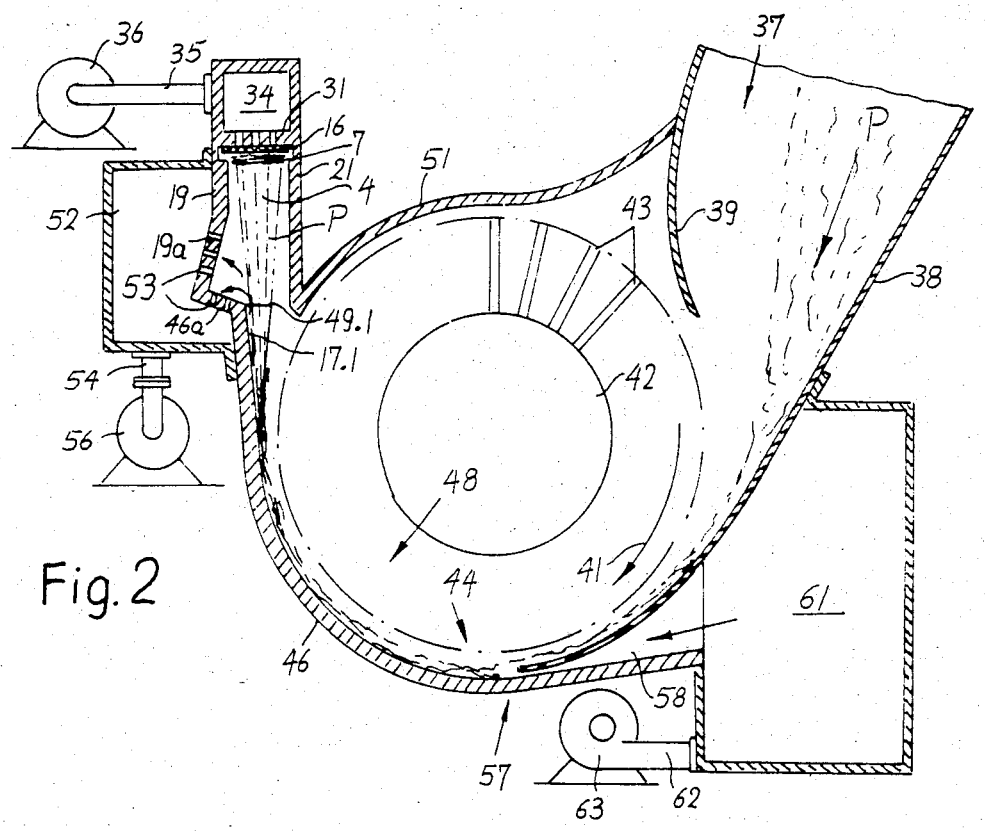
FIG. 2 is a transverse vertical sectional view as seen in the direction of arrows from the line IIa—IIa or from the line IIb—IIb of FIG. 1.
Figure 3:
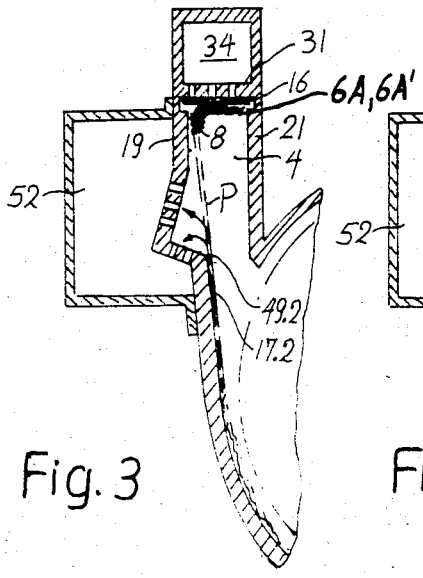
FIG. 3 is a transverse vertical sectional view as seen in the direction of arrows from the line IIIa—IIIa or from the line IIIb—IIIb of FIG. 1.

FIG. 2 is a sectional view which is taken along the line IIa—IIa of FIG. 1. The reference characters which are used in FIG. 2 are not followed by letters "a" because the structure of FIG. 2 is identical with the structure which can be seen in the direction of arrows from the line IIb—IIb of FIG. 1. Thus, the mechanism which supplies particles P into the showering zone A to form the web 6A of the first stream **6*a* is or can be identical with the mechanism which supplies particles P into the showering zone B to form the web 6A' of the second stream 6*b*. An analogous situation prevails in the regions of section lines IIIa—IIIa and IIIb—IIIb of FIG. 1; therefore, the numerals which are used in FIG. 3 are not followed by letters "a" or "b" because the mechanism which forms the leg 6B of the stream 6*a* is or can be identical with the mechanism which forms the leg 6B' of the stream 6*b*. Still further, the mechanism which is shown in FIG. 3 can be used to make the leg 6C of the stream 6*a* or the leg 6C' of the stream 6*b***.

The duct D of FIG. 1 can receive particles P of smokable material from a distributor of the type disclosed in commonly owned U.S. Pat. No. 4,185,644 granted Jan. 29, 1980 to Heitmann et al. As can be seen in FIG. 2, the upper side of the lower reach of the belt conveyor 16 (which may be the belt conveyor **16*a* or 16*b*) is adjacent to the perforated bottom wall 31 of the suction chamber 34 whose outlet is connected to the intake of the fan 36 by the aforementioned suction pipe 35. The arrows 18*a* and 18*b* denote in FIG. 1 the directions in which the respective belt conveyors 16*a*, 16*b* are driven by the prime mover of the cigarette rod making machine, e.g., by an electric motor of the type shown in FIG. 1 of the aforementioned patent to Heitmann et al. The pressure differential which is established by the suction chamber 34 of FIG. 34 suffices to ensure that the particles P adhere to and advance with the underside of the lower reach of the belt conveyor 16**.

The distributor further comprises a funnel 37 which is formed by walls 38, 39 and delivers particles P into the range of pins or studs 43 on a wheel 42 which is driven at a constant speed and serves to entrain the arriving particles P toward and past the outlet of a nozzle 57. The wheel 42 rotates in the direction which is indicated by the arrow 41 and the tips of its pins 43 entrain the particles P along a step 44 at the lower end of the wall 38 and thereupon along the concave internal surface of a further wall 46. The centers of curvature of the walls 38, 46 at the opposite sides of the step 44 are located on the axis of the wheel 42. That portion of the internal surface of the wall 46 which is disposed directly below the conveying means T1 or T2 (i.e., directly below the respective conveyor **16*a* or 16*b*) is flat or substantially flat, as at 17.1, and its inclination is such that the particles P which advance therealong are caused to enter a predetermined portion of the U shaped trough 4 including the lower reach of the conveyor 16 and the sidewalls 19, 21. The walls 38, 39, 46 together constitute a composite guide 48 which advances the particles P along a predetermined path extending from the inlet of the funnel 37 to the underside of the lower reach of the conveyor 16. The upper end portion 46*a* of the wall 46 is strongly inclined in a direction to the left, as viewed in FIG. 1, so as to form a reasonably sharp propelling edge 49.1. The inclination of the surface 17.1 upstream of the propelling edge 49.1 varies, as considered in a direction from the right to the left in the duct Da and in a direction from the left to the right, as viewed in the duct Db. This ensures that the particles P which form the web 6A or 6A' are distributed across the full width of the bottom wall of the trough 4*a* or 4*b*, namely, across the full width of the lower reach of the belt conveyor 16*a* or 16*b***.

The sidewall 21 of FIG. 2 merges into a further arcuate wall 51 which overlies the wheel 42 and extends to the wall 39 of the funnel 37. The lower portion **19*a* of the sidewall 19 flares outwardly and away from the propelling edge 49.1 and merges into the upper end portion 46*a* of the wall 46. The portion 19*a* has holes 53 which establish communication between the interior of the U-shaped trough 4 and a suction chamber 52 which is connected with the intake of a fan 56 or another suitable suction generating device by a suction pipe 54**.

The discharge end of the nozzle 57 is adjacent to the step 44 between the walls 38 and 46. The walls 58 of the nozzle 57 converge toward each other in a direction toward the step 44, and the inlet of the nozzle 57 is in communication with a plenum chamber 61 which receives compressed air from the outlet of a blower 63 via conduit 62.

The wheel 42 extends along the full length of the duct Da or Db (as viewed from the left to right in FIG. 1) so that it cooperates with the guide 48 to deliver particles P to each of the three zones Z1, Z2, Z3 in the respective duct. As mentioned above, the inclination of the surface 17.1 varies in the respective zone Z1 so that the particles P which are propelled beyond the edge 49.1 can form the entire web 6A or 6A' before the particles which rise in the respective zone Z2 can form the leg 8 (corresponding to the leg 6B or 6B') in a manner as shown in FIG. 3 which shows that the surface 17.2 of the wall 46 defines a propelling edge 49.2 whose inclination varies along the zone Z2. The surface 17.3 in the structure of FIG. 3 defines an edge 49.3 for particles P which are pneumatically propelled toward the inner side of the sidewall 21 to form the leg 9 (corresponding to the leg 6C or 6C'). The surfaces 17.1 (FIG. 2), 17.2 (FIG. 3) and 17.3 (FIG. 4) extend substantially tangentially of the adjacent portion of the wheel 42, and they can be readily machined with a requisite degree of precision to ensure that, when the rate of delivery of particles P is at least substantially constant, the apparatus of FIGS. 2 to 4 will build a trough-shaped stream 6a or 6b whose shape is predictable and thus ensures that the shape of the third stream 12, which is formed in the region of merger C, matches or does not appreciably deviate from an optimum shape.

The nozzle 57 ensures that the particles P which are propelled beyond the edge 49.1, 49.2 or 49.3 advance at an elevated speed, and the inclination of the surfaces 17.1, 17.2 and 17.3 is such that they cause the particles P to form relatively thin webs 6A or 6A' and relatively thin legs 8 and 9, namely the thickness of the parts of the streams 6a and 6b should not be excessive in order to ensure that the density of the central portion 2 of the third stream 12 will be less than that of the outer layer 3 of the stream 12 and also that the central portion of the filler in the rod 1 will be less dense than the outer layer 3 of the rod.

Figure 4:
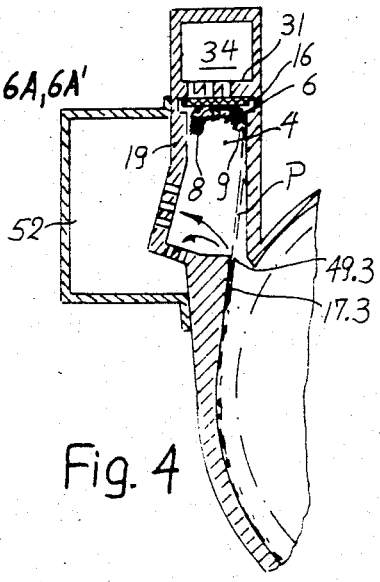
FIG. 4 is a transverse vertical sectional view as seen in the direction of arrows from the line IVa—IVa or from the line IVb—IVb of FIG. 1.

It is clear that the orientation of the surfaces 17.2 and 17.3 can be such that the legs 9 are formed ahead of the legs 8. It is also possible to form the legs 8 and/or 9 ahead of the webs 6A, 6A'. In the embodiment of FIGS. 1 to 7, the webs 6A, 6A' are formed ahead of the legs 8 and the legs 8 are formed ahead of the legs 9, i.e., the surface 17.2 of FIG. 3 is inclined to the left so that it propels particles P against the inner side of the sidewall 19, and the surface 17.3 of FIG. 4 is inclined in a direction to the right so as to propel particles P toward the inner side of the sidewall 21.

The mode of operation of the machine which embodies the apparatus of FIGS. 1 to 4 is as follows:

The distributor delivers particles P of smokable material into the funnel 37 wherein the particles advance into the range of and are entrained by the tips of the pins 43 on the wheel 42 to move in the direction of arrow 41 and into the range of the stream of compressed air issuing from the nozzle 57 at a level below the step 44. The stream of air which issues from the nozzle 57 transports the particles 57 along the concave side of the wall 46 and toward and along the surfaces 17.1, 17.2 and 17.3. Depending on the inclination of the surfaces 17 in the various zones Z1, Z2 and Z3, the particles P which are propelled beyond the respective edges 49.1, 49.2 and 49.3 are caused to form the webs 6A, 6A' and legs 8 (6B, 6B') and 9 (6C, 6C') of the respective first and second streams 6a, 6b.

The major part of the air stream which is supplied by the nozzle 57 is evacuated through the holes 53 of the wall portion 19a to enter the suction chamber 52. This prevents excessive accumulation of air in the spaces below the undersides of the lower reaches of the belts 16a, 16b and the development of eddy currents which could interfere with predictable formation of the streams 6a and 6b.

As shown in FIGS. 2, 3 and 4, the upper end portion 46a of the wall 46 is also formed with holes 53 to further promote the outflow of air from the respective trough 4 into the suction chamber 52 The remainder of each air stream is caused to pass through the lower reach of the respective belt conveyor 16a, 16b and the perforated bottm wall (31 in FIGS. 2–4) of the corresponding suction chamber 34a or 34b to ensure that the growing and fully grown streams 6a, 6b are adequately attracted to the bottom walls of the respective troughs 4 on their way toward the region C of merger to form the third stream 12. The feature that the holes 53 are provided in the offset or laterally recessed portions 19a and 46a of the respective walls 19 and 46 is desirable and advantageous because this reduces the likelihood of clogging of such holes with particles of smokable material. As mentioned above, the concave sides 5a, 5b of the first and second streams 6a 6b face each other on their way toward the region C as well as subsequent to their conversion into the third stream 12.

An advantage of smokers' products which are obtained in response to severing of the rod 1 of FIG. 7 is that the firmness of the articles is satisfactory even though the overall quantity of smokable material therein is less than in a conventional cigarette or the like. Moreover, the combustion of smokable material on lighting of a smokers' article which is obtained as a result of severing of the rod 1 of FIG. 7 is more satisfactory than that of an article whose filler has a constant density across its entire cross section.

FIGS. 8 to 11 illustrate a portion of a cigarette rod making machine which embodies a modified apparatus having a stationary mandrel 281. All such parts of this apparatus which are identical with or clearly analogous to the corresponding parts of the apparatus of FIGS. 1 to 4 are denoted by similar reference characters plus 100. The mandrel 281 extends at least to the region C of merger of the trough-shaped streams 106a, 106b in order to ensure that the central portion or core 102 of the filler in the finished wrapped rod 101 (FIG. 11) will be devoid of any particles or will contain a relatively small quantity of particles so that its density will be zero or a minute fraction of the density of the annular outer layer 103 of the filler in the tubular wrapper 113 of FIG. 11.

Figures 8, 9, 10, 11, 12:
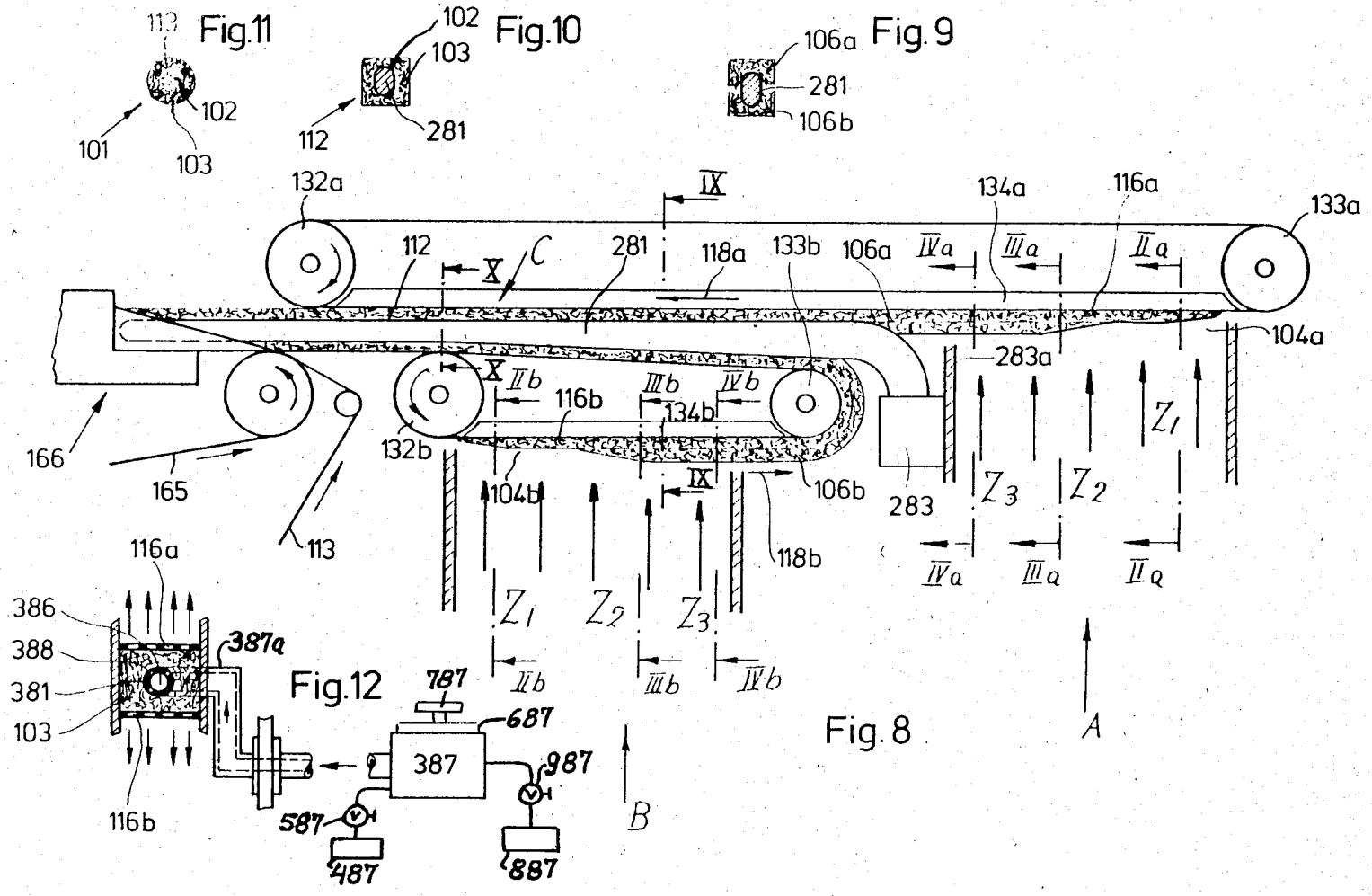
FIG. 8 is a schematic elevational view of a portion of a cigarette rod making machine which embodies a modified apparatus.
FIG. 9 is a fragmentary transverse vertical sectional view as seen in the direction of arrows from the line IX—IX of FIG. 8.
FIG. 10 is a fragmentary transverse vertical sectional view as seen in the direction of arrows from the line X—X of FIG. 8.
FIG. 11 is a transverse sectional view of the wrapped rod which is produced in the machine of FIG. 8.
FIG. 12 is a fragmentary transverse vertical sectional view of a third apparatus employing a stationary mandrel which constitutes a modification of the mandrel shown in FIGS. 8 to 10.

The mandrel 281 is mounted on a stationary wall or frame member 283a of the machine and its major portion extends substantially horizontally into the space between the streams 106a, 106b. The right-hand end portion of the mandrel 281, as viewed in FIG. 8, is attached to a vibrator 283 which is preferably arranged to vibrate the mandrel 281 at a frequency in the ultrasonic range. In the embodiment of FIGS. 8 to 11, and as shown in FIG. 10, the length of the mandrel 281 is such that a portion thereof extends into the third stream 112 and actually all the way to the inlet (or even beyond the inlet) of the wrapping mechanism 166. This ensures that the central portion 102 of the third stream 112 is devoid of particles of smokable material and that such central portion receives a relatively small number of particles (if any) only during conversion of the third stream 112 into the filler of the rod 101 which is shown in FIG. 11. If desired, the length of the mandrel 281 can be reduced, even considerably, depending upon the desired differences between the densities of the central portion 102 and the annular outer layer 103 of the filler in the rod 101 as well as upon the desired additional or ancillary functions of the mandrel. A comparison of FIGS. 10 and 11 will reveal that the cross-sectional area of the mandrel 281 diminishes in a direction from the vibrator 283 toward the wrapping mechanism 166.

FIG. 12 shows in greater detail one presently preferred embodiment of the mandrel. This mandrel is denoted by the character 381 and is preferably stationary save for the vibratory movements which are or may be imparted thereto for the purpose of reducing friction between its external surface and the adjacent particles of smokable material which form the streams 106a, 106b or the third stream 112. The means for further reducing friction between the external surface of the mandrel 381 and the adjacent (advancing) particles of smokable material comprises a source 387 of compressed air which is connected with the inlet of a centrally located passage 386 in the mandrel 381 by a conduit 387*a*. The shell of the mandrel 381 has ports or otherwise configurated openings 388 which admit streamlets of compressed air into the space around the external surface of the mandrel to thus greatly reduce friction between the mandrel and the particles of smokable material.

The source 387 of compressed air is connected with a source 487 of one or more volatile flavoring agents of the type customarily added to tobacco to enhance its aroma and/or other desirable properties. The connection between the sources 387 and 487 comprises a combined shutoff and regulating valve 587 which can be adjusted by hand or by remote control. An important advantage of the source 487 and mandrel 381 is that they can admit highly or moderately volatile flavoring agents to particles of smokable material immediately before such particles enter the wrapping mechanism 166, i.e., the flavoring agent or agents cannot escape ahead of the station where the web 113 is draped around the filler which is obtained on compacting of the third stream 112. This entails surprisingly large savings in flavoring agents. At the present time, flavoring agents are added to particles of tobacco or other smokable material ahead of the distributor so that they must be added in large quantities since a major percentage of such agents will evaporate on their way toward the draping station. The admission of one or more flavoring agents immediately ahead of the draping station constitutes a novel feature which brings about substantial savings in flavoring agents and (depending on the nature of flavoring agents) results in a pronounced improvement of the quality of air around the rod making machine.

FIG. 12 further shows that the source 387 of compressed air can be connected with a heater 687 which is adjustable by a knob 787 or the like so as to enable an operator or suitable remote controls to select the temperature of hot air which is admitted into the streams 106*a*, 106*b* and/or into the stream 112. For example, the heater 687 can be designed to raise the temperature of air from room temperature (approximately 20° C.) to a temperature of approximately 40° C. The admission of heated air also contributes to a reduction of friction between the external surface of the mandrel 381 and the adjacent particles of smokable material. Furthermore, heating of air which issues from the source 387 may be desirable and advantageous if such air contains one or more flavoring agents.

The source 387 is further connected with a source 887 of moisture (e.g., water or steam which is admitted by way of a conduit containing an adjustable regulating valve 987 so that the operators or remote controls can regulate the percentage of moisture which is admitted into the streams 106*a*, 106*b* and/or into the stream 112. Moreover, the provision of valve 987 or other suitable regulating means renders it possible to regulate the extent of penetration of moisture into the smokable material around the mandrel. In many instances, it is desirable to limit the admission of moisture to the region immediately adjacent to the mandrel 381 and to leave the moisture content of the major portion of the outer layer 103 unchanged. The admission of a certain amount of moisture (e.g., water vapors) ensures that the particles which are immediately adjacent to the external surface of the mandrel 381 during travel toward and beyond the region C of merger can more readily move relative to each other during densification of the stream 112 in the wrapping mechanism 166. The admission of hot air and/or moisture via mandrel 381 or an analogous insert also constitutes a novel and advantageous feature which is believed to merit patent protection independently of as well as jointly with the aforediscussed method of and apparatus for forming a rod wherein the density of the central portion is zero or less than the density of the outer layer.

The vibrator 283 for the mandrel 381 has been omitted in FIG. 12 for the sake of clarity.

The structures which can be seen from the lines IIa—IIa and IIb—IIb, IIIa—IIIa and IIIb—IIIb, IVa—IVa and IVb—IVb in FIG. 8 are or can be identical with the structures shown in FIGS. 2, 3 and 4, respectively.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of forming a continuous rod-like filler from particles of smokable material, comprising the steps of accumulating the particles into discrete continuous first and second trough-shaped streams; merging said streams into a single continuous third stream having a tubular outer layer and a core whose density is less than that of the outer layer; and converting the third stream into a continuous rod-like filler having a core of lesser density and an annular outer layer of greater density, said converting step including subjecting the third stream to the action of substantially radially oriented densifying forces.

2. The method of claim 1, wherein said accumulating step includes imparting to each of said first and second streams a substantially U-shaped cross-sectional outline with a concave inner side and said merging step includes moving said first and second streams along convergent paths wherein their concave inner sides face each other.

3. The method of claim 1, wherein said accumulating step includes showering the particles into two discrete elongated paths and establishing a pressure differential at the opposite sides of each path so that the particles are pneumatically held in their respective paths.

4. The method of claim 3, wherein said establishing step includes placing an air-permeable coneyor into each of said paths and evacuating air from one side of each conveyor, said showering step including delivering the particles to the other side of each conveyor.

5. The method of claim 1, further comprising the step of advancing the first and second streams along at least substantially horizontal paths at least prior to said merging step.

6. The method of claim 5, wherein said accumulating step further comprises placing air-permeable conveyors into the bottom regions of elongated troughs having a substantially U-shaped cross-sectional outline and showering the particles against the conveyors and adjacent portions of the troughs so that each of the first and second streams has a substantially U-shaped cross-sectional outline.

7. The method of claim 6, wherein said showering step includes propelling the particles at an elevated speed and at an oblique angle to the direction of movement of the conveyors to form a first portion of each of the first and second streams.

8. The method of claim 7, wherein said showering step further includes propelling the particles at an elevated speed and in at least substantial parallelism with the direction of movement of the conveyors to thus form the remainder of each of the first and second streams.

9. The method of claim 1, wherein the tubular outer layer of the third stream has a substantially square cross-sectional outline and the outer layer of the filler has a substantially circular cross-sectional outline.

10. Apparatus for forming a rod-like filler from smokable particles, comprising first and second conveyor means each having a concave side; means for supplying to the concave side of each of said conveyor means smokable particles to thus form thereon continuous first and second streams having concave sides; and means for merging the first and second streams on said conveyor means into a third stream wherein the concave sides of the first and second streams face each other.

11. The apparatus of claim 10, wherein each of said conveyor means comprises a belt conveyor and said supplying means includes means for showering the particles onto said belt conveyors.

12. The apparatus of claim 11, wherein each of said belt conveyors is permeable to air and said conveyor means further comprise suction chambers adjacent to the respective belt conveyors opposite the concave sides of the corresponding conveyor means so that the showered particles are attracted to said belt conveyors by suction.

13. The apparatus of claim 10, wherein said conveyor means define substantially horizontal paths for the first and second streams.

14. The apparatus of claim 10, wherein each of said conveyor means defines an elongated trough having a bottom wall and each of said conveyor means comprises an endless belt conveyor constituting the bottom wall of the respective trough.

15. The apparatus of claim 14, wherein each of said conveyor means further comprises two sidewalls flanking the respective bottom wall, said supplying means comprising first units arranged to deliver particles to the belt conveyors and additional units arranged to deliver particles to the sidewalls of the respective conveyor means.

16. The apparatus of claim 10, further comprising a mandrel disposed between said conveyor means, at least in the region of said merging means, to prevent penetration of particles into the central region of the third stream.

17. The apparatus of claim 16, further comprising means for reducing friction between the particles and said mandrel.

18. The apparatus of claim 17, wherein said mandrel has air-discharging openings and said friction reducing means comprises means for admitting air into said openings.

19. The apparatus of claim 16, further comprising means for vibrating said mandrel.

20. The apparatus of claim 19, wherein said vibrating means includes means for vibrating said mandrel at a frequency which is in the ultrasonic range.

21. The apparatus of claim 16, further comprising a source of flavoring agents and means for admitting such agents into said third stream through said mandrel.

22. The apparatus of claim 16, further comprising means for admitting heated air into the streams by way of said mandrel.

23. The apparatus of claim 16, further comprising means for admitting into said streams moist air by way of said mandrel.

24. The apparatus of claim 23, further comprising means for regulating the rate of admission of moist air via said mandrel so that the moisture comes in contact only with the central portion of the third stream.

25. The apparatus of claim 16, further comprising means for admitting into said streams steam by way of said mandrel.

26. The apparatus of claim 25, further comprising means for regulating the rate of admission of steam via said mandrel so that the steam contacts only the central portion of said third stream.

27. The apparatus of claim 16, further comprising means for condensing the third stream and for draping the condensed third stream into a web of wrapping material, said mandrel extending into or close to said condensing means.

* * * * *